US007456565B2

(12) United States Patent
Nomura et al.

(10) Patent No.: US 7,456,565 B2
(45) Date of Patent: Nov. 25, 2008

(54) ELECTRON EMITTING DEVICE, ELECTRON SOURCE, IMAGE DISPLAY APPARATUS AND IMAGE RECEIVING DISPLAY APPARATUS

(75) Inventors: Kazushi Nomura, Sagamihara (JP); Hidehiko Nakajima, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 580 days.

(21) Appl. No.: 11/313,717

(22) Filed: Dec. 22, 2005

(65) Prior Publication Data

US 2006/0214561 A1 Sep. 28, 2006

(30) Foreign Application Priority Data

Dec. 28, 2004 (JP) ..... 2004-379953

(51) Int. Cl.
*H01J 1/88* (2006.01)
*H01J 1/30* (2006.01)

(52) U.S. Cl. ..... 313/497; 313/495; 313/309

(58) Field of Classification Search ..... 313/309, 313/414, 495–497, 346 R
See application file for complete search history.

(56) References Cited

U.S. PATENT DOCUMENTS 5,786,658 A * 7/1998 Tsukamoto et al. ..... 313/309
6,515,640 B2 * 2/2003 Tsukamoto et al. ..... 313/495
6,853,126 B2 2/2005 Nomura ..... 313/492
6,975,288 B2 12/2005 Nishimura et al. ..... 345/74.1
7,388,326 B2 * 6/2008 Ryu ..... 313/497
2005/0200266 A1 9/2005 Nomura ..... 313/495

FOREIGN PATENT DOCUMENTS

JP 64-54649 3/1989
JP 64-54650 3/1989
JP 2001-118488 4/2001

* cited by examiner

*Primary Examiner*—Nimeshkumar D Patel
*Assistant Examiner*—Christopher M Raabe
(74) *Attorney, Agent, or Firm*—Fitzpatrick, Cella, Harper & Scinto

(57) ABSTRACT

An electron emitting device comprising on a substrate: an electrode extracting electrons from the electron emitting portion, the electrode applied with a voltage higher then the cathode electrode; and an deflecting electrode deflecting the electrons extracted from the electron emitting portion by the extraction electrode, the deflecting electrode applied with the voltage lower than the voltage of the extraction electrode; wherein the electron emitting device is disposed so as to be opposed to an anode electrode, and the extraction electrode is disposed between the cathode electrode and the deflecting electrode, and wherein the deflecting electrode comprises a portion opposed to the electron emitting portion, and other portions disposed to nip a region between the electron emitting portion and said portion in a direction crossing the direction along which the portion and the electron emitting portion are opposed.

6 Claims, 9 Drawing Sheets

ELECTRON EMITTING DEVICE, ELECTRON SOURCE, IMAGE DISPLAY APPARATUS AND IMAGE RECEIVING DISPLAY APPARATUS

BACKGROUND OF THE INVENTION

1. Field of the Invention

The present invention relates to an electron source, an image display apparatus, and an image receiving display apparatus, which are used for a TV receiver, a display device of a computer, an electron beam scribing apparatus, and the like.

2. Related Background Art

Heretofore, in general, as an electron emitting device, there has been a field emission electron emitting device.

In one of the field emission electron emitting devices, there has been a so-called Spindt type electron emitting device where an electron emitting portion is shaped like a circular cone or a quadrangular pyramid in the direction vertical to a substrate surface.

In the Spindt type electron emitting device, an electron emitting characteristic greatly depends on the shape of the circular cone or the quadrangular pyramid which is the electron emitting device. However, there has been a problem in that it is difficult to form the circular cone or the quadrangular pyramid easily and with good reproducibility.

Hence, for the purpose of manufacturing the electron emitting device with a simple constitution and good reproducibility, a constitution having a cathode electrode, an extracting electrode opposing to the cathode electrode, and a deflecting electrode vertically deflecting the electrons extracted from the extracting electrode on the same substrate has been disclosed in Japanese Patent Application Laid-Open No. S64-054649.

However, according to the constitution disclosed in Japanese Patent Laid Open No. S64-054649, since the end portion of the deflecting electrode at the side of the extracting electrode is extended in the vertical direction for the traveling direction of electrons, the trajectory of electrons has often been kept spread in the vertical direction for the traveling direction of electrons, thereby being deflected in the vertical direction for the substrate surface. Hence, if the electron emitting device of Japanese Patent Laid-Open No. S64-054649 is applied to the image display apparatus, the region of electrons reaching the positive electrode disposed in opposition to the electron emitting device is prone to spread. On the other hand, in recent years, the image display apparatus has come to be required much higher resolution.

SUMMARY OF THE INVENTION

The present invention has been carried out in order to solve the above described problems, and an object of the invention is to constitute an electron emitting device capable of controlling the region of electrons reaching an anode electrode by a simple constitution.

The present invention is an electron emitting device, in which a cathode electrode comprising an electron emitting portion, an electrode to extract electrons from the electron emitting device, the extraction electrode applied with a voltage higher than the electric voltage of the cathode electrode, and an deflecting electrode to deflect the electrons extracted from the electron emitting portion by the extraction electrode, the deflecting electrode applied with the voltage lower than the voltage of the extraction electrode are provided on a substrate, wherein the electron emitting device is disposed so as to be opposed to an anode electrode, and the extraction electrode is disposed between the cathode electrode and the deflecting electrode, and wherein said deflecting electrode comprises a portion opposed to said electron emitting portion, and other portions disposed to nip a region between said electron emitting portion and said portion in a direction crossing the direction along which said portion and said electron emitting portion are opposed.

According to the present invention, the electron emitting device of a simple constitution where the spots of electrons reaching the anode electrode are small can be realized. As a result, in the image display apparatus using the electron emitting device of the present invention, the image of high resolution can be displayed.

DETAILED DESCRIPTION OF THE PREFERRED EMBODIMENTS

Embodiments of the present invention will be described in details below with reference to the drawings.

First Embodiment

Figure 1:
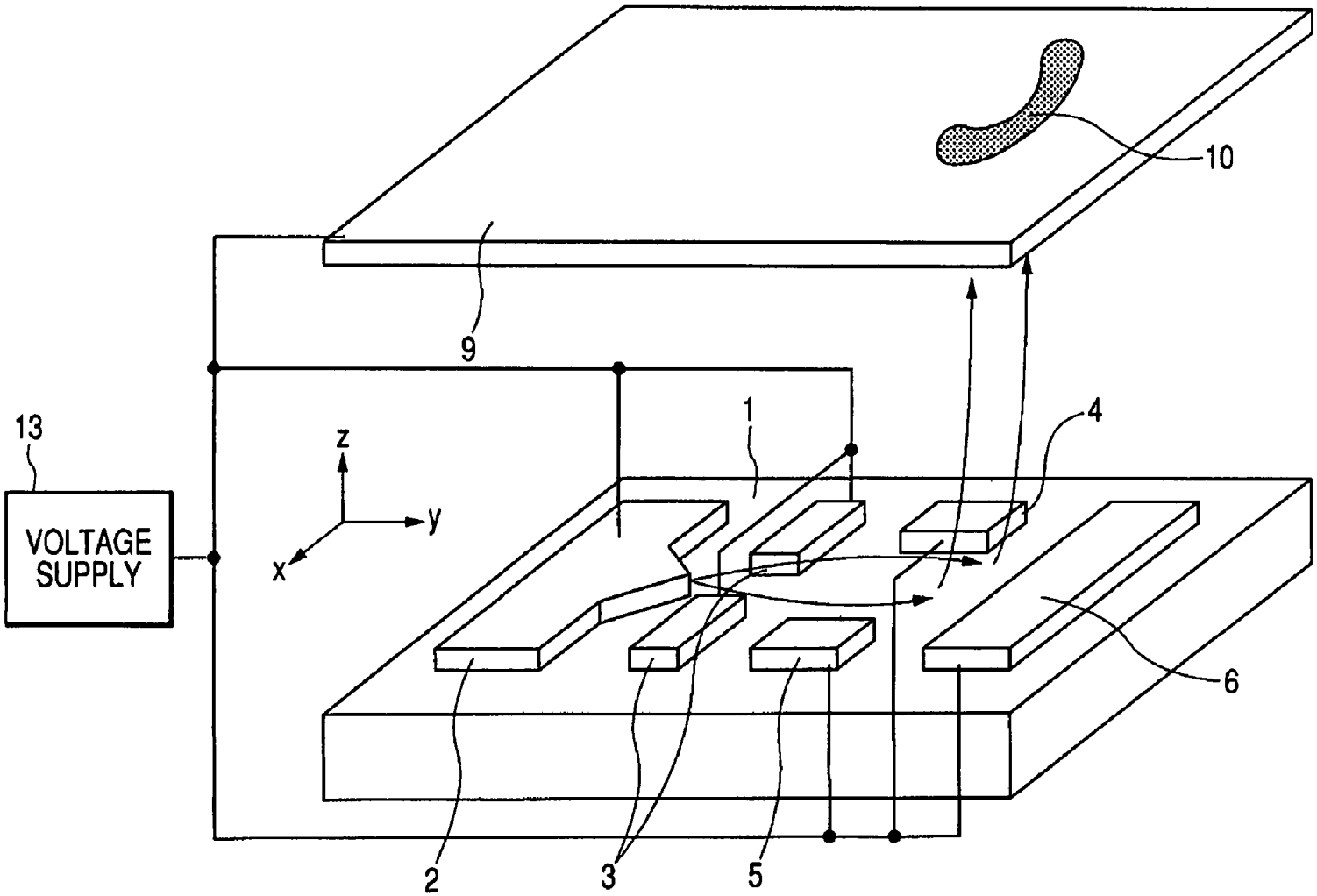
FIG. 1 is a schematic illustration showing the constitution of an electron emitting device according to the present invention.

An electron emitting device according to a first embodiment of the present invention will be described by using a schematic illustration shown the FIG. 1. FIG. 1 shows an oblique view of the electron emitting device according to the present embodiment. In the Figure, reference numeral 1 denotes a substrate, reference numeral 2 denotes a cathode electrode, reference numeral 3 denotes an extraction electrode, reference numeral 4 denotes a first deflecting electrode, reference numeral 5 denotes a second deflecting electrode, reference numeral 6 denotes a third deflecting electrode, reference numeral 9 denotes an anode electrode, reference numeral 10 denotes an electron beam irradiating region, and reference numeral 13 denotes voltage supply means. Further, arrow marks in the Figure show the trajectories of the electrons emitted from the electron emitting portion of the cathode electrodes 2 at the driving time.

The electron emitting device of the present embodiment applies a voltage to each electrode as described below, and emits electrons from the electron emitting portion of the cathode electrode 2. Each electrode is supplied with the voltage from the voltage supply means 13. The voltage supply means 13 is preferably a power supply that can stably supply the voltage. In case the voltage supply means 13 comprises one power supply, by adjusting the voltage by voltage drop, a plurality of different voltages can be supplied to each electrode. Further, the voltage supply means 13 is constituted by a plurality of power supplies which can supply different voltage, respectively.

In order that the voltage of the cathode electrode 2 becomes less than the voltage of the extraction electrode 3, the voltage is applied between the cathode electrode 2 and the extraction electrode 3. For the cathode electrode 2, the voltage applied to the extraction electrode 3 can be made practically not more than 100 V. Preferably in consideration of the load of a driving circuit, it is not more than 50 V. Further, in order that the voltages of deflecting electrodes 4 to 6 become low for the voltage of the extraction electrode 3, the voltage is applied between the cathode electrode 2 and the deflecting electrodes 4 to 6. For the cathode electrode 2, the voltage applied to the deflecting electrodes 4 to 6 can be made practically not less than −100 V or can be made below the voltage applied to the extraction electrode 3 for the cathode electrode 2. Preferably it is not less than −50 V or it is within the range below the voltage applied to the extraction electrode 3 for the cathode electrode 2. It is simple and preferable that the voltages applied to the first deflecting electrode 4, the second deflecting electrode 5, and the third deflecting electrode 6 are the same, but different voltages can be also applied to each of deflecting electrodes. By applying different voltages, the position where electrons reach the anode electrode can be controlled. In this manner, when the substrate and the anode electrode are faced with each other, in case a displacement is generated between a predetermined position of the substrate and the corresponding position of the anode electrode, the position where electrons reach the anode electrode can be easily corrected.

Further, for the cathode electrode 2, the voltage not less than 1 kV and not more than 30 kV is applied to the anode electrode 9.

Electrons emitted from the electron emitting portion pass through the opening provided in the extraction electrode 3, and reach the region (deflecting region) surrounded by the first deflecting electrode 4, the second deflecting electrode 5, and the third deflecting electrode 6.

The deflecting electrode comprises a portion disposed so as to be opposed to the electron emitting portion, and moreover, in a direction to cross the direction where the deflecting electrode and the electron emitting portion are opposed, a portion disposed so as to nip the region between the electron emitting portion and a portion disposed so as to be opposed to the electron emitting portion of the deflecting electrode. That is, the third deflecting electrode 6 is disposed so as to be opposed to the electron emitting portion, and the first deflecting electrode 4 and the second deflecting electrode 5 are disposed so as to nip electrons emitted from the electron emitting portion. Consequently, in the present embodiment, a member including the portion disposed so as to be opposed to the electron emitting portion and a member including other portions disposed so as to nip the region between the electron emitting portion and the above described portion in the direction to cross the direction where the deflecting electrode and the electron emitting portion are opposed are separated. The deflecting electrode disposed so as to nip electrons emitted from the electron emitting portion is preferably in the direction to cross the direction where the portion disposed so as to be opposed to the electron emitting portion and the electron emitting portion are opposed, and is preferably in a vertical direction.

Consequently, due to the effect of the electric field formed by the voltages applied to the first deflecting electrode 4 and the second deflecting electrode 5, the electrons put into orbit of an arrow mark of FIG. 1 are deflected so as to be focused in an X direction. Further, the electrons having passed through the opening of the extraction electrode 3 according as drawing closer to the third deflecting electrode 6 gradually slow down in a Y direction due to the effect of the electric field formed by the voltage applied to the third deflecting electrode 6, and preferably stop. In case the voltage applied to the third deflecting electrode 6 for the cathode electrode 2 is negative, the electrons reaching the vicinity of the third deflecting electrode 6 lose energy to travel in the Y direction (or stop), and subsequently, displace in the reverse direction.

On the other hand, the electrons emitted from the electron emitting portion of the cathode electrode 2, due to the effect of the electric field formed by the voltage applied to the anode electrode 9 disposed so as to be opposed to the electron emitting device, receive an attracting force in the Z direction to travel to the anode electrode 9.

The electrons emitted from the electron emitting portion of the cathode electrode 2 travel in the Y direction at high speed, and therefore, until drawing closer to the third deflecting electrode 6, does not displace sharply in Z direction even when receiving the attracting force in the Z direction by the anode electrode 9. However, the speed of the electrons in the Y direction drops according as drawing closer to the third deflecting electrode 6, and as a result, the majority of electrons are extracted in the Z direction from the vicinity of third deflecting electrode 6 and reach the anode electrode 9. Since the electrons extracted in the Z direction are already focused by the first deflecting electrode 4, the second deflecting electrode 5, and the third deflecting electrode 6, the region where the electrons reach on the anode electrode 9 can be made small.

Next, the constitution of the electron emitting device according to the present embodiment will be described by using FIGS. 2A to 2D.

Figure 2A:
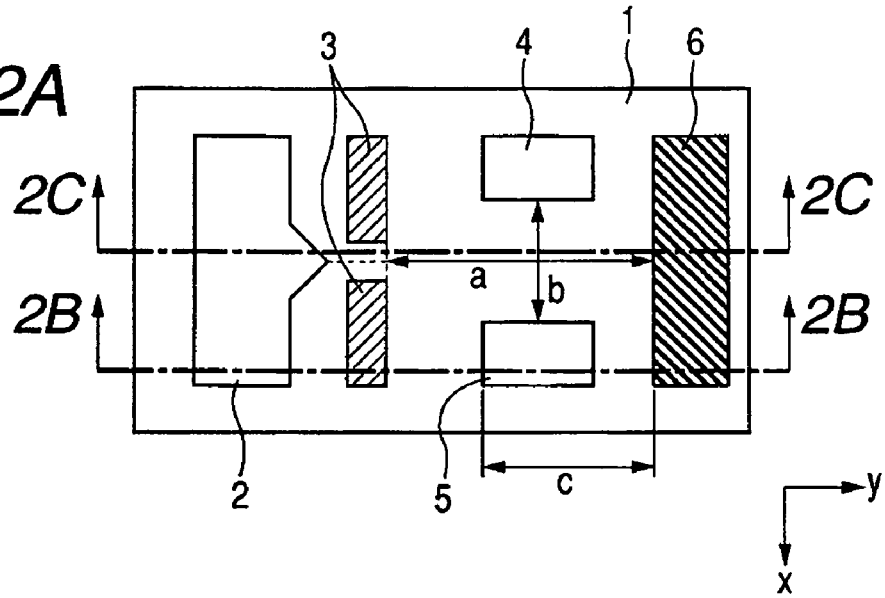
FIGS. 2A, 2B, 2C and 2D are schematic illustrations showing the constitution of the electron emitting device according to the present invention.
Figure 2B:
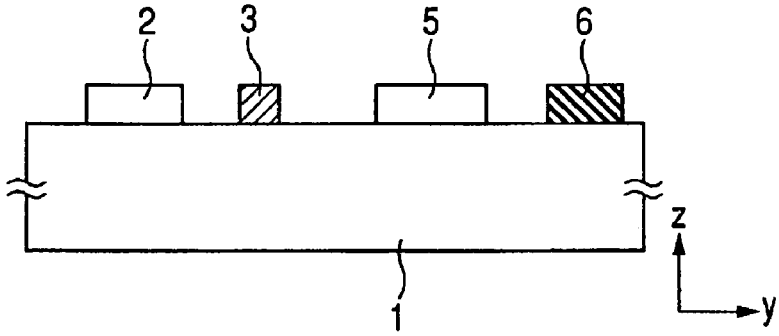
Figure 2C:
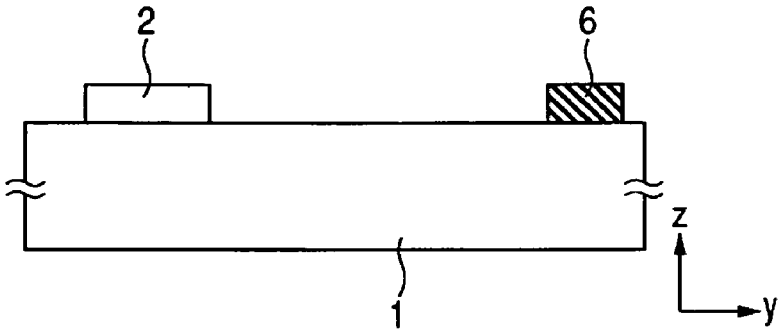

FIG. 2A shows a top plan view of the electron emitting device according to the present embodiment shown in FIG. 1, and FIG. 2B shows a sectional view cut along the line 2B-2B in FIG. 2A, and FIG. 2C shows a sectional view cut along the line 2C-2C in FIG. 2A.

As the material of the substrate 1, an insulating material is preferable, and to be specific, a quartz glass, a substrate comprising a glass where impurity content such as Na and the like is reduced, a substrate comprising a laminated product laminating SiO2 on a soda lime glass, a silicon substrate and the like by a sputtering method and the like, and ceramics and the like such as alumina and the like can be cited.

In FIG. 2A, the shortest distance from the protruded portion of the cathode electrode 2 protruding to the opening of the extraction electrode 3 to the end portion of the extraction electrode 3 at the side of the cathode electrode 2 can be taken as 0.2 μm to 1.5 μm. Here, the end portion means a contour portion of the member in the top plane view. The shape of the protruded portion of the cathode electrode 2 is not limited to the shape as shown in FIG. 2A. The interval of the openings for the electrons to pass through provided in the extraction electrode 3 can be taken as 0.5 μm to 3 μm. In the present embodiment, while the members constituting the extraction electrode 3 are provided in opposition to the cathode electrode 2 and the electrons are allowed to pass through the opening between the members, the opening is provided in such a manner as to have its portion connected to the extraction electrode 3 comprising one member, and the electrons are preferably allowed to pass through this opening. Further, the extraction electrode 3 thinner than the thickness of the cathode electrode 2 is provided, and the electrons emitted from the electron emitting portion are preferably allowed to pass through on the extraction electrode 3. Further, from among the extracting electrode 3 shown in FIG. 2A, one of the portions to nip the opening may be removed.

In the sectional views of the electron emitting device according to the present embodiment shown in FIGS. 2B and 2C, the sectional shapes of the electrodes 2 to 6 disposed on the substrate 1 are not limited to a shape of rectangle, but may be a shape having a taper such as a semi-circle, a trapezoid and the like.

As the material used for each electrode, a metal or an alloy material such as Be, Mg, Ti, Zr, Hf, V, Nb, Ta, Mo, W, Al, Cu, Ni, Cr, Au, Pt, Pd and the like, and carbide such as TiC, ZrC, HfC, TaC, SiC, WC and the like, and boride such as $HfB_2$, $ZrB_2$, $LaB_6$, $CeB_6$, $YB_4$, $GdB_4$ and the like, and nitride such as TiN, Zrn, HfN and the like, and a semiconductor and the like such as Si, Ge and the like can be cited. The protruded portion of the cathode electrode 2 can be covered by a material whose work function lower than the work function of the material used for the cathode electrode 2. Further, the protruded portion of the cathode electrode 2 can be preferably disposed with carbon fiber such as carbon nanotube and the like.

Here, as shown in FIG. 2A, the shortest distance between a nodal point with the center line of the opening provided in the extraction electrode 3 and a surface including the end portion, at the side of deflecting electrodes, of the extraction electrode 3 and the end portion, at the side of the electron emitting portion, of a portion disposed so as to be opposed to the electron emitting portion from among the deflecting electrodes is taken as a. In other words, a can be taken as the shortest distance between the extracting electrode 3 and the third deflecting electrode 6. Further, the shortest distance between the portions disposed so as to nip the electrons emitted from the electron emitting portion from among the deflecting electrodes is taken as b. That is, b can be taken as the shortest distance between the first deflecting electrode 4 and the second deflecting electrode 5. Further, the shortest distance between the end portion, at the side of the electron emitting portion, of the portion disposed so as to be opposed to the electron emitting portion from among the deflecting electrodes and the surface including the end portion, at the side of the extraction electrode 3, of a portion disposed so as to nip the electrons emitted from the electron emitting portion from among the deflecting electrodes is taken as c. That is, c can be taken as the shortest distance between the end portion, at the side of the electron emitting portion, of the third deflecting electrode 6 and the surface including the end portion, at the side of the extraction electrode 3, of either of the first deflecting electrode 4 and the second deflecting electrode 5.

Figure 2D:
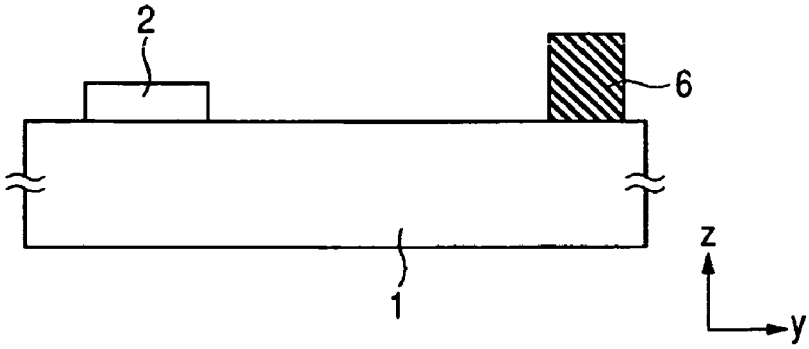

At this time, the range of a, b and c can be taken as not more than 500 μm, and more preferably can be taken as not less than 1 μm and not more than 100 μm. Further, the distance between the cathode electrode 2 and the anode electrode 9 is taken as h, and the thickness of the extracting electrode 3 as p, and the thickness of the third deflecting electrode 6 as q. The range of h can be taken as not more than 10 mm, and more preferably can be taken as not less than 0.5 μm and not more than 5 mm. The range of P and q can be taken as not less than 20 nm and not more than 1 μm. The thickness of the first deflecting electrode 4 and the second deflecting electrode 5 is preferably taken as not more than three times the thickness of the end portion, at the side of the third deflecting electrode 6, of the cathode electrode 2. Further, as shown in FIG. 2D, the thickness of the third deflecting electrode 6 is preferably the same as the thickness of the cathode electrode 2 or not less than that thickness. In other words, the height from the substrate 1 of the electron emitting portion of the cathode electrode 2 is preferably not more than the height from the substrate 1 of the portion opposed to the electron emitting portion of the third deflecting electrode 6. By so doing, without depending on the voltage applied to the third deflecting electrode 6, the electrons extracted from the electron emitting portion of the cathode electrode 2 can be allowed to travel in a direction vertical to an equipotential surface formed by the third deflecting electrode 6, and more effectively can be slowed down and stopped in the Y direction in the vicinity of the third deflecting electrode 6.

The voltage applied to the extraction electrode 3 for the cathode electrode 2 is taken as Vg, the voltage applied to the third deflecting electrode 6 for the cathode electrode 2 is taken as Vf, and the voltage applied to the anode electrode 9 for the cathode electrode 2 as Va.

When the electrons are emitted from the electron emitting portion of the cathode electrode 2, a design is made so as to satisfy the following relational formulas 1 and 2.

In the case of $0 \leqq Vf < Vg$, $$a \geqq \sqrt{\frac{hq}{Va}}\left(\sqrt{Vg} + \sqrt{Vf}\right) \text{ and } b \leqq 4a \text{ and } c \leqq 4b \qquad \text{(Formula 1)}$$

In the case of $Vf < 0$, $$a \geqq \sqrt{\frac{hp}{Va}\,\frac{(Vg - Vf)}{2\sqrt{Vg}}} \text{ and } b \leqq 4a \text{ and } c \leqq 4b \qquad \text{(Formula 2)}$$

In the case of $0 \leqq Vf < Vg$, by setting up a constitution so as to satisfy the above described relational formula 1, the electrons extracted from the electron emitting portion of the cathode electrode 2 travel to the region surrounded by the first deflecting electrode 4, the second deflecting electrode 5, and the third deflecting electrode 6, and are focused in the X direction. Further, the electrons can reach the anode electrode 9 without colliding against the third deflecting electrode 6.

In the case of $Vf < 0$, by setting up a constitution so as to satisfy the above described relational formula 2, the electrons extracted from the electron emitting portion of the cathode electrode 2 travel to the region surrounded by the first deflecting electrode 4, the second deflecting electrode 5, and the third deflecting electrode 6, and are converged in the X direction. The electrons are displaced in the direction in reverse to the traveling direction, and can reach the anode electrode 9 without colliding against the extraction electrode 3.

Consequently, by satisfying the above described relationships, the broadening in the X direction and the Y direction of an electron beam irradiation region 10 of the anode electrode 9 can be controlled.

Figure 3A:
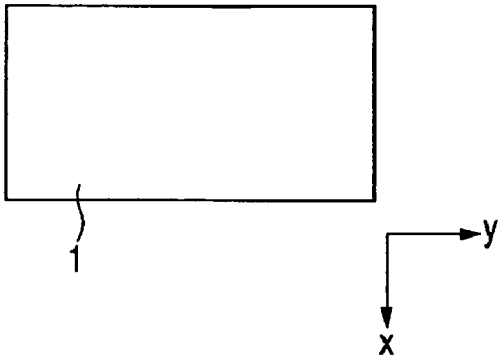
FIGS. 3A, 3B, 3C, 3D, 3E and 3F are schematic illustrations showing the manufacturing method of the electron emitting device according to the present invention.
Figure 3B:
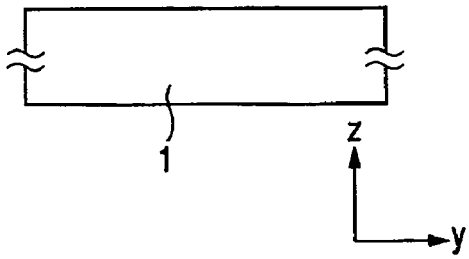
Figure 3C:
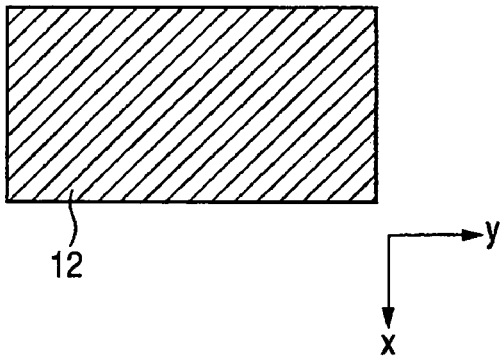
Figure 3D:
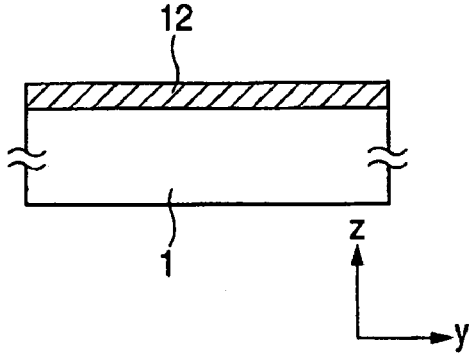
Figure 3E:
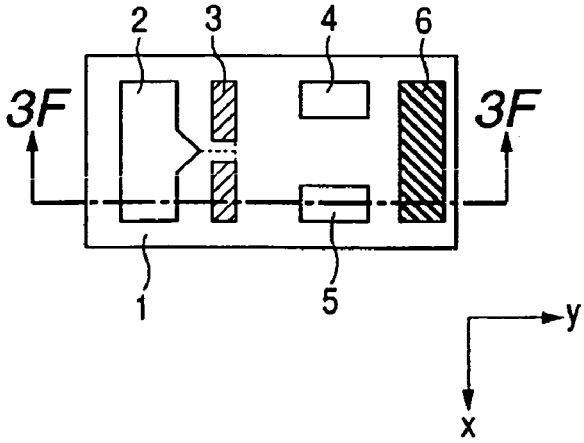
Figure 3F:
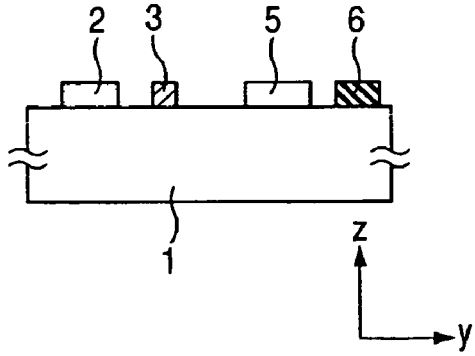

Next, one example of the manufacturing method the electron emitting device according to the present embodiment will be described by using FIGS. 3A to 3F. FIGS. 3A, 3C and 3E show a top plan view, and FIGS. 3B and 3D show sectional views of FIGS. 3A and 3C, respectively, and FIG. 3F shows a sectional view cut along the line 3F-3F of FIG. 3E. The electron emitting device of the present embodiment can be prepared, for example, by the following (process a) to (process c).

(Process a)

The substrate 1 is set up (FIGS. 3A and 3B).

(Process b)

A conductive film is laminated on the surface of the substrate 1 (FIGS. 3C and 3D).

As the method of laminating the conductive film, a vacuum evaporation method, a sputtering method h a printing method and the like can be used.

(Process c)

On the surface of the substrate 1, the cathode electrode 2, the extraction electrode 3, the first deflecting electrode 4, the second deflecting electrode 5, and the third deflecting electrode 6 are formed (FIGS. 3E and 3F).

As for the method of forming the cathode electrode 2, the extraction electrode 3, the first deflecting electrode 4, the second deflecting electrode 5, and the third deflecting electrode 6, a FIB (focused ion beam) method, a photolithography technology, and the like can be used.

Second Embodiment

Figure 4A:
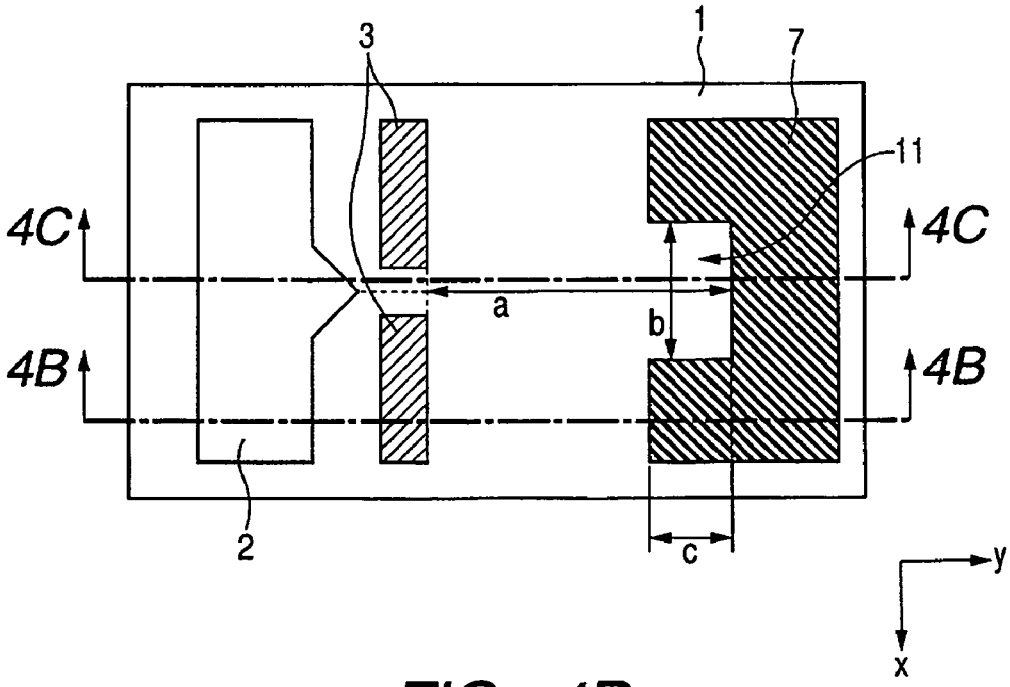
FIGS. 4A, 4B and 4C are schematic illustrations showing the constitution of the electron emitting device according to the present invention.
Figure 4B:
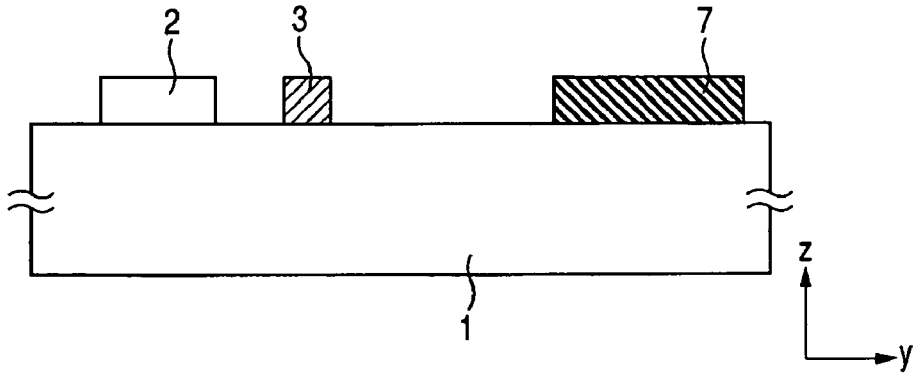
Figure 4C:
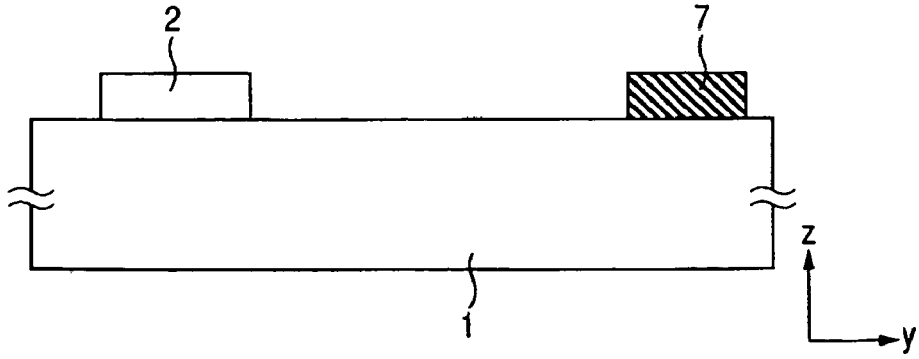

An electron emitting device according to a second embodiment of the present invention is schematically shown in FIGS. 4A, 4B and 4C.

The electron emitting device according to the present embodiment is the same as the electron emitting device according to the first embodiment except that one deflecting electrode is provided in place of the first deflecting electrode, the second deflecting electrode, and the third deflecting electrode. The same reference numerals are attached to the same constituent members. The portion different from the first embodiment will be described below.

FIG. 4A shows a top plan view of the electron emitting device according the present embodiment, and FIG. 4B shows a sectional view cut along the line 4B-4B of the FIG. 4A, and FIG. 4C shows a sectional view cut along the line 4C-4C of FIG. 4A. In FIGS. 4A to 4C, reference numeral 7 denotes a deflecting electrode, and reference numeral 11 denotes a deflecting region.

From among the end portions, at the side of the extraction electrode 3, of the deflecting electrode 7, one portion is constituted to be distant from the extraction electrode 3 further than the other portion.

In FIGS. 4A to 4C, while an example has been shown where the sectional shape (shape of the end portion of the deflecting electrode 7) of the surface in parallel with the substrate surface of a deflecting region 11 is formed in the shape of an rectangle, it is not limited to the shape of rectangle, but may be a part of a circular shape or the shape of a polygon. Further, while the substrate 1 is formed so as to be exposed in the deflecting region 11, a conductive film can be provided on the surface of the substrate 1 so that the substrate 1 in the deflecting region 11 is not exposed. By providing the conductive film in this manner, the electrons can be prevented from colliding with and charging on the surface of the substrate 1. In this case, the thickness of the conductive film is desirable to be thin. In the first embodiment, it is possible for the same reason to provide the conductive film also on the surface of the substrate 1 in the deflecting region surrounded by the deflecting electrodes 4 to 6.

In FIG. 4A, the shortest distance between the extraction electrode 3 and the portion distant from the extraction electrode 3 from among the end portions, at the side of the extraction electrodes 3, of the deflecting electrode 7 is taken as a, the length in a X direction of the deflecting region 11 as b, and the length in a Y direction of the deflecting region 11 *c*, thereby making a design so as to satisfy the same relationship as the first embodiment.

By constituting each of the deflecting electrodes 4 to 6 in the first embodiment so as to be connected in this manner, the wiring structure to apply the voltage to the electrodes and the driving circuit constitution can be made simple.

Third Embodiment

Figure 5A:
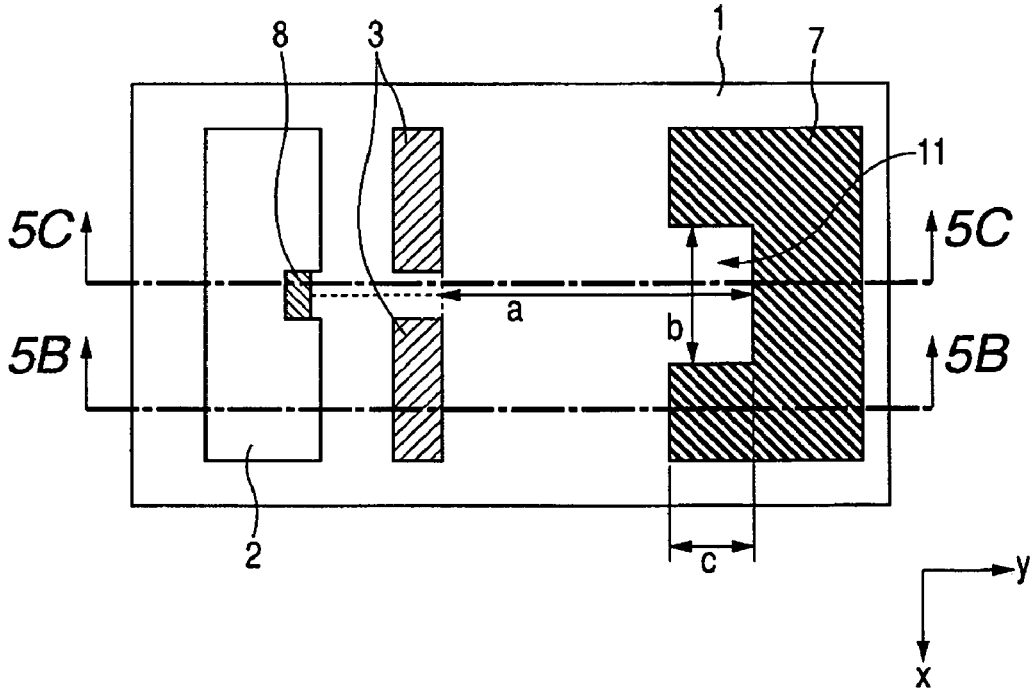
FIGS. 5A, 5B and 5C are schematic illustrations showing the constitution of the electron emitting device according to the present invention.
Figure 5B:
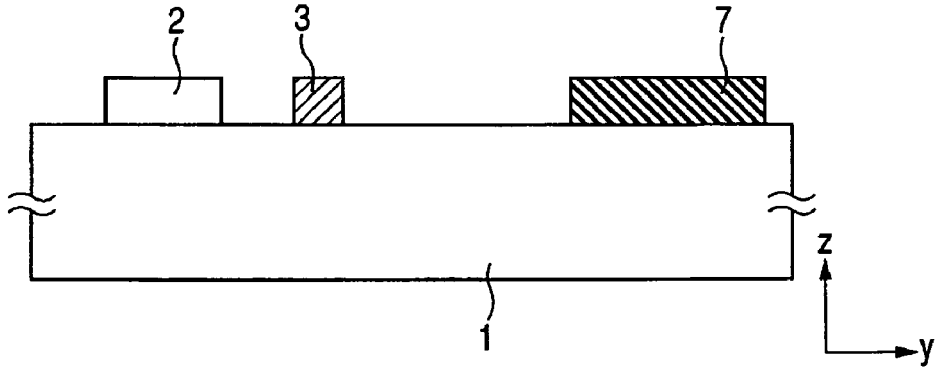
Figure 5C:
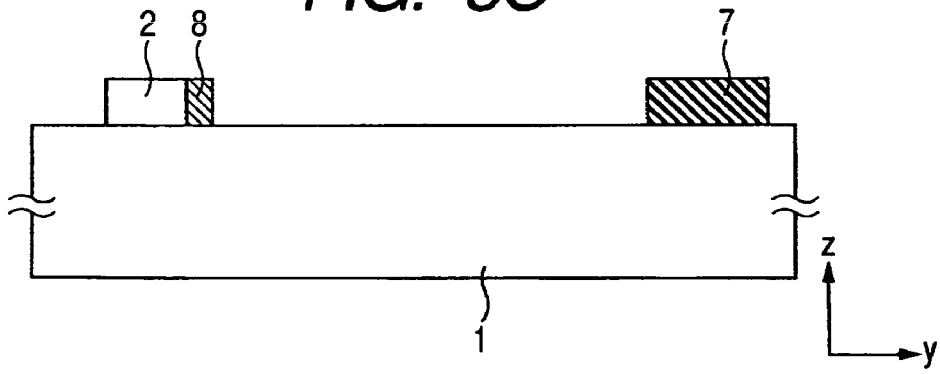

An electron emitting device according to a third embodiment of the present invention is schematically shown in FIGS. 5A, 5B, and 5C.

The electron emitting device according to the present embodiment is the same as the electron emitting device according to the second embodiment except that, from among the end portion, at the side of an extraction electrode 3, of a cathode electrode 2, a portion is isolated from the extraction electrode 3 further than distant other portion, and the distant portion is provided with the electron emitting member 8. Consequently, the same constituent member is attached with the same reference numeral, and the portion different from the second embodiment will be described below.

FIG. 5A shows a top plan view of the electron emitting device according to the present embodiment, FIG. 5B shows a sectional view cut along the line 5B-5B of FIG. 5A, and FIG. 5C shows a sectional view cut along the line 5C-5C of FIG. 5A. In FIGS. 5A to 5C, reference numeral 8 denotes an electron emitting member.

For the electron emitting member 8, a material capable of emitting electrons in much lower electric field strength compared with the material of the cathode electrode 2 is used. With the electron emitting member 8 constituted in such a manner, when a voltage is applied to each electrode so as to allow the electron emitting member 8 to emit the electrons, an equipotential surface between the cathode electrode 2 and the extraction electrode 3 is formed so as to focus the electrons emitted from the electron emitting member 8. Consequently, the electrons extracted from the electron emitting member 8 can enhance focusing property, compared with the constitution of the cathode electrode 2 as shown in the second embodiment.

As the material used for the electron emitting member 8, graphite, amorphous carbon, diamond like carbon, diamond, fullerene, carbon fiber such as carbon nanotube, and the like can be cited. Further, the distance between the end portion, at the side of the extraction electrode 3, of the cathode electrode 2 and the end portion, at the side of the cathode electrode 2, of the extraction electrode 3 can be taken as the range of 0.5 μm to 3 μm. The width in the X direction of the concave portion formed at the end portion, at the side of the extraction electrode 3, of the cathode electrode 2 can be taken as the range from 0.5 μm to 100 μm.

In the present embodiment, from among the end portion, at the side of the extraction electrode 3, of the cathode electrode 2, a portion is distant from the extraction electrode 3, and the portion is disposed with the electron emitting member 8. In this manner, in the present embodiment, the width in the X direction of an electron beam irradiating region emitted from the electron emitting member 8 and irradiated to an anode electrode can be made much narrower.

Fourth Embodiment

Figure 6:
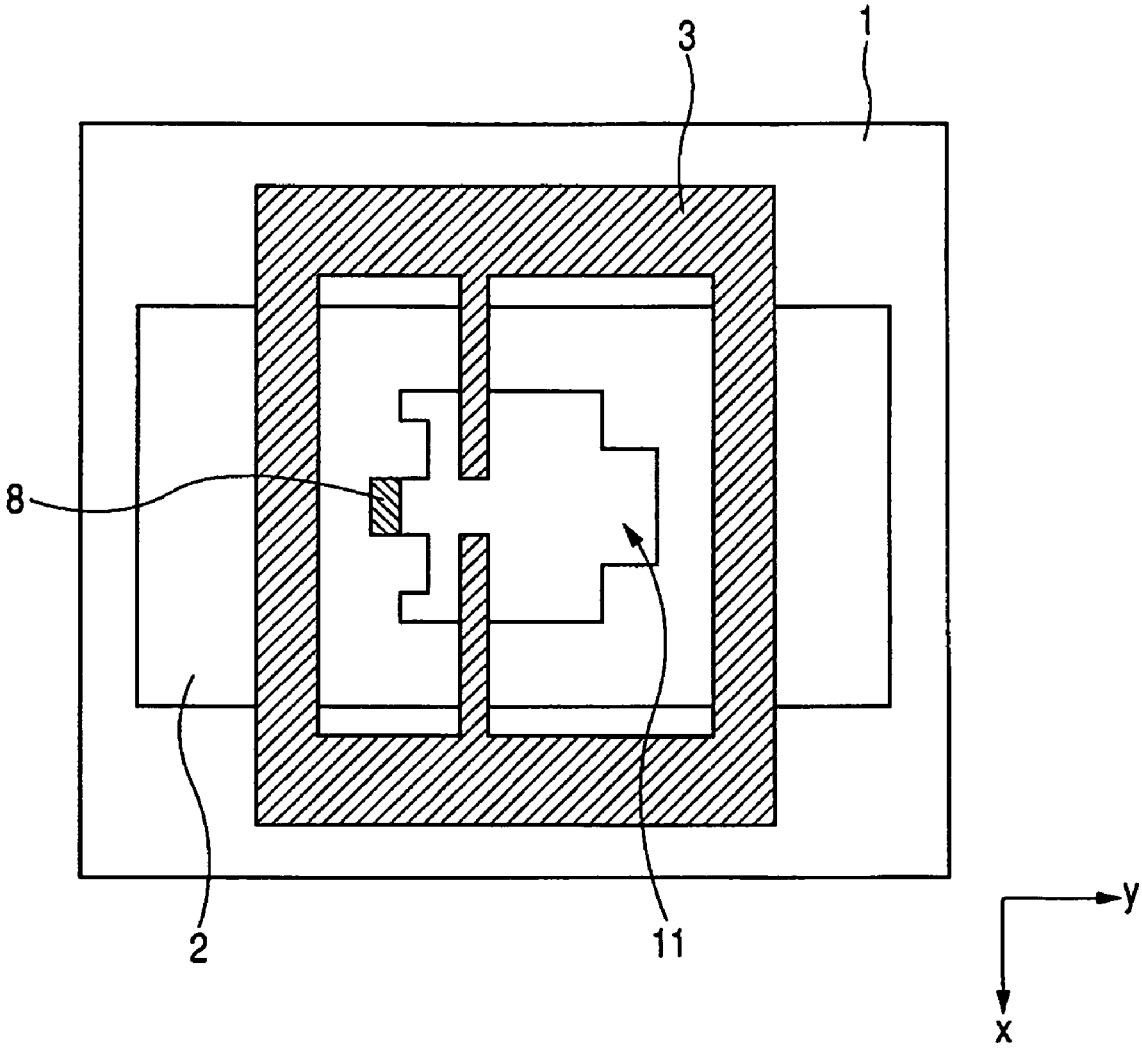
FIG. 6 is a schematic illustration showing the constitution of the electron emitting device according to the present invention.

An electron emitting device according to a fourth embodiment of the present invention is schematically shown in FIG. 6.

The electron emitting-device according to the present embodiment is an example of simple constitution where the cathode electrode 2 and the deflection electrode 7 of the third embodiment are connected. With respect to the same constituent members as the electron emitting device according to the third embodiment, the same reference numerals are attached. The characteristic portion of the present embodiment will be described below. While the cathode electrode of the third embodiment is used for the cathode electrode, the cathode electrode of the first embodiment can be also used.

FIG. 6 shows a top plan view of the electron emitting device according to the present embodiment. In the present embodiment, a deflecting electrode and a cathode electrode are constituted by the same member. Further, while an extraction electrode, 3 is overlaid and disposed on a cathode electrode 2, the cathode electrode 2 may be overlaid and disposed on the extraction electrode 3. In the portion where the cathode electrode 2 and the extraction electrode 3 are overlaid, there is nipped an insulating layer (not, shown) so that the portion is not electrically connected.

By constituting the deflecting electrode and the cathode electrode so as to be connected, the wiring structure to apply the voltage to the electrode and the constitution of the driving circuit can be made much simpler.

Fifth Embodiment

Figure 7:
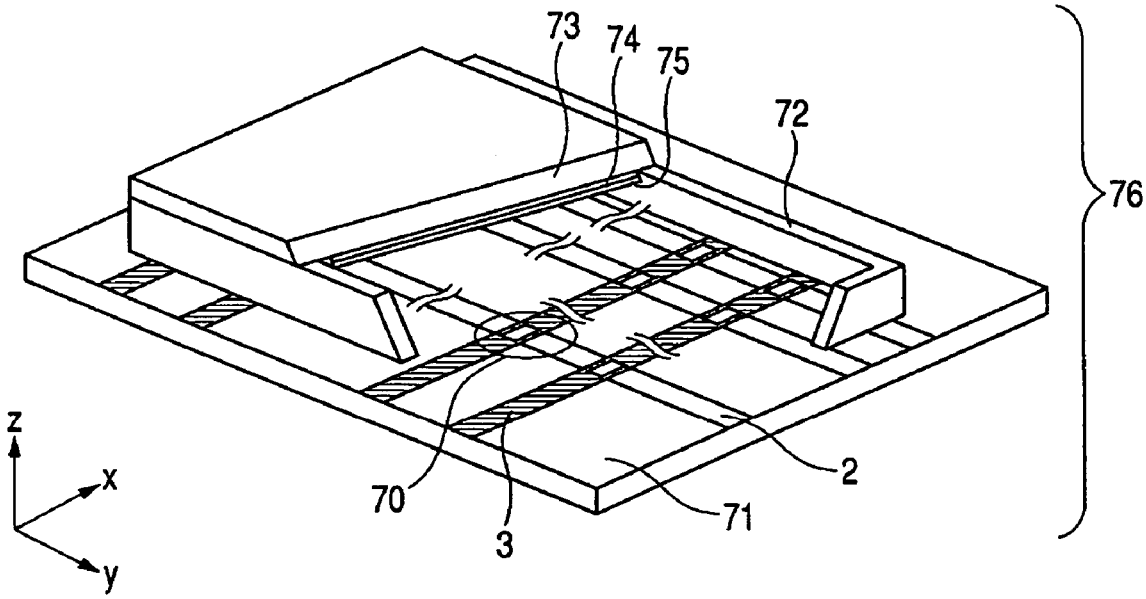
FIG. 7 is a schematic illustration showing the constitution of an image display apparatus according to the present invention.

An image display apparatus according to a fifth embodiment of the present invention is schematically shown in FIG. 7. For an electron emitting device disposed on an electron source substrate, the electron emitting device of the first to fourth embodiments is used. Here, an example using the electron emitting device according to the fourth embodiment will be shown.

In FIG. 7, reference numeral 70 denotes an electron emitting device of the present invention, reference numeral 71 denotes an electron source substrate disposed with a plurality of electron emitting devices 70, reference numeral 72 denotes a support frame, reference numeral 73 denotes a glass substrate, reference numeral 74 denotes a fluorescent screen, and reference numeral 75 denotes a metal back. While a cathode electrode 2 and an extraction electrode 3 may have a function as a row-directional wiring and a column-directional wiring, respectively, the cathode electrode 2 and the extraction electrode 3 may be connected to the row-directional wiring and the column-directional wiring, respectively. The support frame 72 is joined with the electron source substrate 71 and a face plate constituted by a fluorescent screen 74 and the metal back 75 on the inner surface of the glass substrate 73 by using a frit glass having a low melting point and the like.

An envelope 76 is constituted by the face plate, the support frame 72, and the electron source substrate 71.

Further, between the face plate and the electron source substrate 71, there is provided at least one piece of a support body (not shown) which is called a spacer, so that the envelope 76 having sufficient strength against an atmospheric pressure can be also constituted.

The image display apparatus is constituted by the electron emitting device 70 disposed on the electron source substrate 71, the cathode electrode 2, the extraction electrode 3, and the envelope 76.

Figure 8:
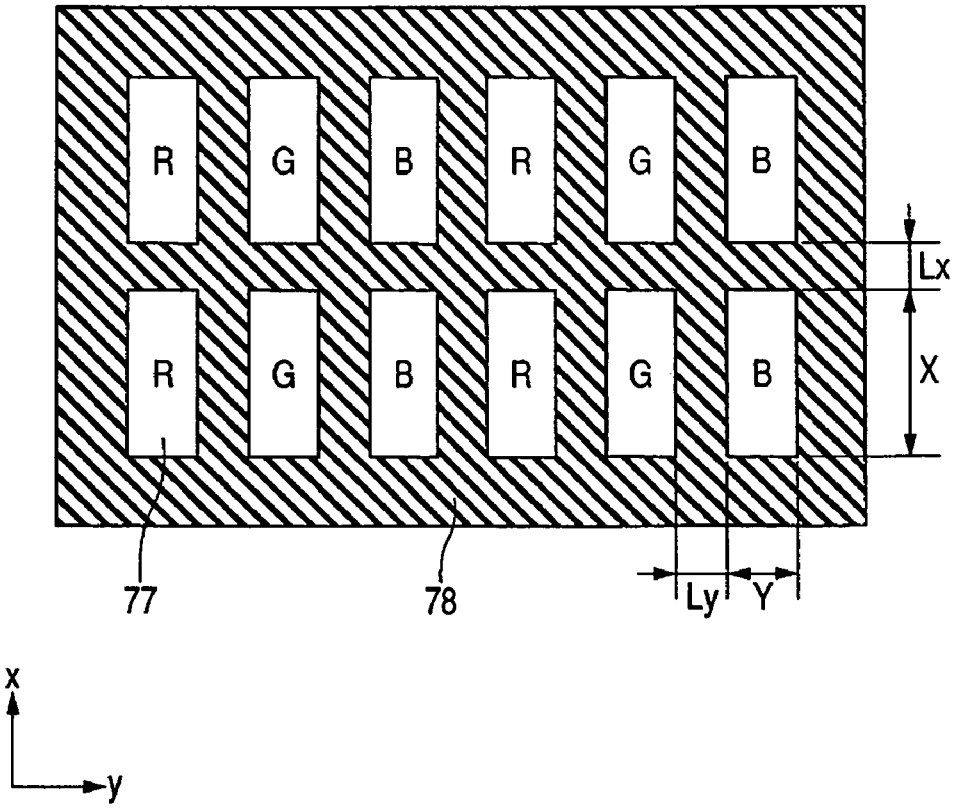
FIG. 8 is a schematic illustration showing the constitution of a fluorescence screen of the image display apparatus according to the present invention.

In FIG. 8 is schematically shown a portion of the fluorescent screen 74. In the Figure, Reference numeral 77 denotes a fluorescent member being a light-emitting member, and reference numeral 78 denotes a light absorbing member. The fluorescent member 77 corresponding to a luminescent color desired to be displayed is regularly disposed, and the desired fluorescent member 77 is allowed to emit light, so that an image can be displayed on the outer surface of the glass substrate 73. The fluorescent member 77 is separated by the light absorbing member 78. The purpose of providing the light absorbing member 78 is to make the color mixture and the like of each fluorescent member 77 of the three primary colors required in the case of a color display inconspicuous and to control a lowering of the contrast and the like. In the present invention, the electron emitting device 70 is disposed on the electron source substrate 71 so as to correspond to each fluorescent member 77, thereby allowing the electrons to bombard the desired fluorescent member disposed on the opening of the light absorbing member 78. As the light absorbing member 78, a material having less transmission and reflection can be applied, and typically, a black color member called a black matrix can be used. As the material of the black color member, a material mainly composed of graphite can be used. Further, the light absorbing member 78 may have conductivity. The fluorescent member 77, for example, is disposed in order of R (red color), G (green color), and B (blue color) in the Y direction. The fluorescent member 77 of the same color is disposed in the X direction. The length X in the X direction of the fluorescent member 77 can be taken as not less than 100 μm and not more than 300 μm. More preferably it can be taken as not less than 100 μm and not more than 150 μm. Further, the length Y in the Y direction of the fluorescent member 77 can be taken as not less than 70 μm and not more than 180 μm, and more preferably, it can be taken as not less than 70 μm and not more than 115 μm. The width Lx of the light absorbing member 78 separating the intervals of the fluorescent members 77 in the X direction can be taken as the range of not less than 100 μm and not more than 400 μm. The width Ly of the light absorbing member 78 separating the intervals of the fluorescent members 77 in the Y direction can be taken as the range of not less than 20 μm and not more than 100 μm.

Sixth Embodiment

Figure 9:
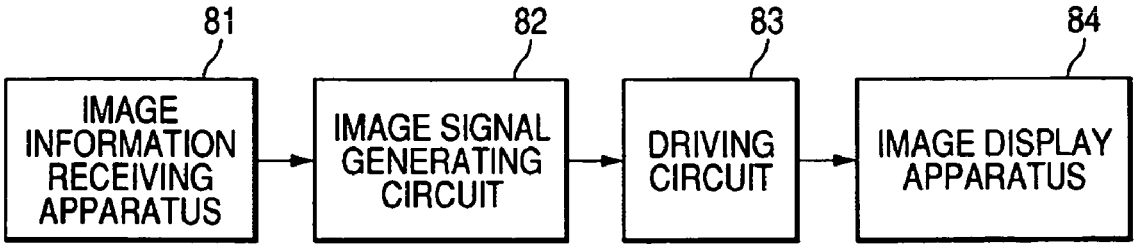
FIG. 9 is a view showing a schematic diagram of an image receiving display apparatus using the electron emitting device according to the present invention.

An image receiving display apparatus according to a sixth embodiment of the present invention is schematically shown in FIG. 9.

In the image receiving display apparatus of the present embodiment, the image display apparatus according to the fifth embodiment is used. In FIG. 9, reference numeral 81 denotes an image information receiving apparatus, reference numeral 82 denotes an image signal generating circuit, reference numeral 83 denotes a driving circuit, and reference numeral 84 denotes the image display apparatus of the present invention. First, the image information selected and received by the image information receiving apparatus 81 is inputted to the image signal generating circuit 82, thereby generating an image signal. As the image information receiving apparatus 81, for example, a receiver such as a tuner can be cited. This receiver can select and receive video broadcasting and the like through radio broadcasting, cable broadcasting, and internet. Further, by connecting the image information receiving apparatus 81 to audio equipment and the like, and moreover, by including the image signal generating circuit 82, the driving circuit 83, and the image display apparatus 84, a television receiver can be constituted. In the image signal generating circuit 82, an image signal corresponding to each pixel of the image display apparatus 84 from the image information is generated, and is inputted to the driving circuit 83. Based on the inputted image signal, the voltage to be applied to the image display apparatus 84 is controlled by the driving circuit 83, thereby allowing the image to be displayed, on the image display apparatus 84.

It will be appreciated that the present invention is not limited to the above described embodiments, and each constituent element may be replaced by any substitute or equivalent thereof if achieving the purpose of the present invention.

EXAMPLE 1

As an example 1, a prepared example of the electron emitting device shown in FIGS. 2A to 2D is shown. In FIGS. 3A to 3F, the manufacturing method of the electron emitting device according to the example 1 is shown. The manufacturing method of the electron emitting device according to the example 1 will be described below in detail.

(Process 1)

The substrate 1 comprising quartz was set up, and cleaning was sufficiently performed (FIGS. 3A and 3B).

(Process 2)

Lift-off patterns of the cathode electrode 2, the extraction electrode 3, the first deflecting electrode 4, the second deflecting electrode 5, and the third deflecting electrode were formed by photo-resist. By vacuum evaporation method, Ti of 5 nm in thickness and Mo of 50 nm in thickness were laminated in order, thereby forming the conductive film 12 (FIGS. 3C and 3D).

(Process 3)

The photo-resist patterns were dissolved by organic solvent, and Mo/Ti lamination films were lift off, thereby forming the cathode electrode 2, the extraction electrode 3, the first deflecting electrode 4, the second electrode 5, and the third deflecting electrode 6 (FIGS. 3E and 3F).

In the first embodiment, the cathode electrode 2 and the third deflecting electrode 6 were formed so as to be in the same thickness.

The shortest distance a between the nodal point between the center line of the opening provided in the extraction electrode 3 and the surface including the end portion, at the side of the deflecting electrode 2, of the extraction electrode 3 and the end portion, at the side of the cathode electrode 2, of the third deflecting electrode 6 was taken as 15 μm, and the shortest distance b between the first deflecting electrodes 4 and the second deflecting electrode 5 was taken as 15 μm, and the shortest distance c between the end portion, at the side of the cathode electrode 2, of the third deflecting electrode 6 and the surface including the end portions, at the side of the cathode electrode 2, of the first deflecting electrode 4 and the second deflecting electrode 5 was taken as 12 μm. Further, the width of the opening of the extraction electrode 3 was taken as 1 μm, and the shortest distance from the top end portion of the cathode electrode 2 protruded toward the opening of the extraction electrode 3 to the extraction electrode 3 was taken as 0.5 μm.

Subsequently, the anode electrode 9 was disposed so as to be opposed to the electron emitting device prepared by the example 1, and in a vacuum envelope, the voltage was applied to the anode electrode 9 and each of the electrodes 2 to 6 of the electron emitting device, thereby estimating the region of the electrons arriving at the anode electrode 9.

The fluorescent screen and the transparent substrate were laminated in order on the rear side of the surface opposed to the electron emitting device of the anode electrode 9, and the side of a light emitting portion was mea in which the electrons emitted from the electron emitting portion of the cathode electrode 2 of the electron emitting device arrived at the anode electrode 9 and emitted the light.

The distance from the surface of the substrate 1 of the electron emitting device to the anode electrode 9 was taken as 2 mm. Further, 0 V was applied to the cathode electrode 2, 50 V was applied to the extraction electrode 3, 0 V was applied to the first deflecting electrode 4, the second deflecting electrode 5, and the third deflecting electrode 6, and 10 kV was applied to the anode electrode 9.

When the region where the maximum brightness of the light emitting portion was not less than 10% was measured as an effective light emitting portion, the length of the effective light emitting portion in the X direction was 115 μm, and the length of the effective light emitting portion in the Y direction was 85 μm.

Figure 10:
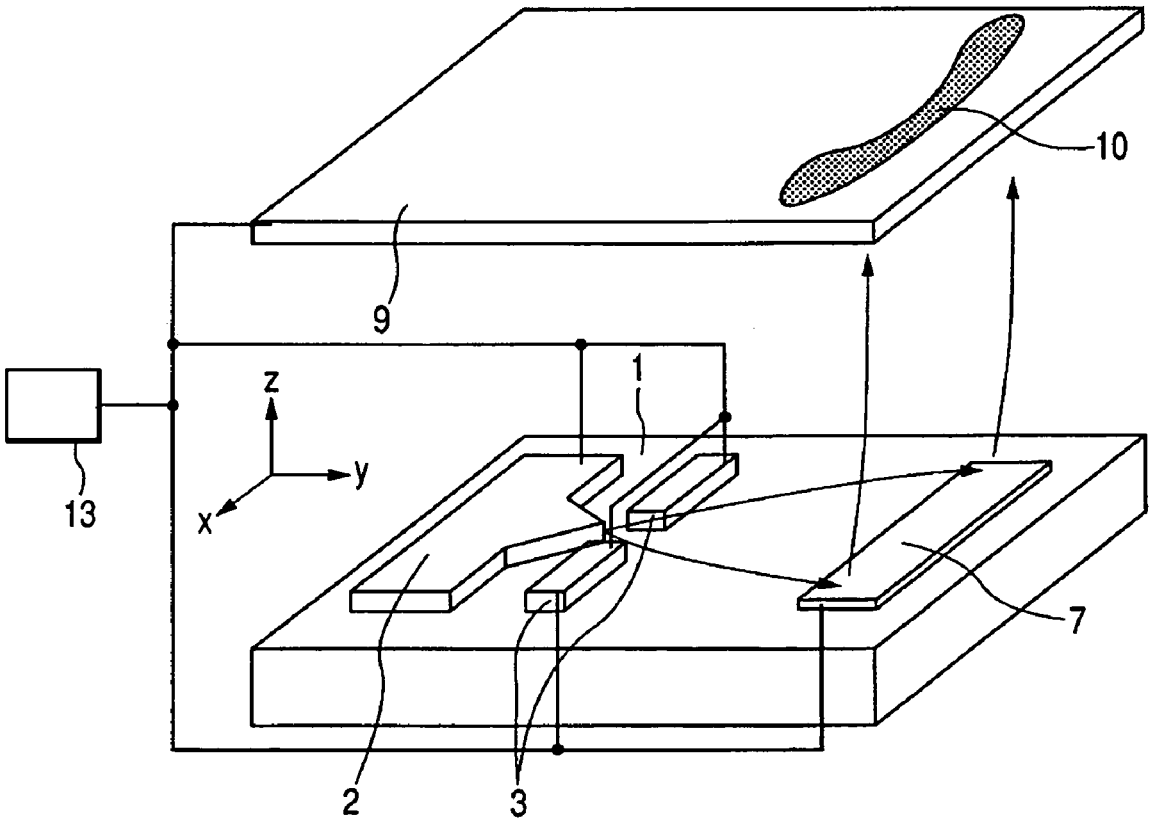
FIG. 10 is a schematic illustration showing the constitution of the electron emitting device according to a comparison example.

Further, as a comparison example 1, the electron emitting device shown in FIG. 10 was prepared.

The electron emitting device was prepared by the same method from the processes 1 to 3 of the example 1. The first deflecting electrode 4 and the second deflecting electrode 5 in FIGS. 2A to 2D were not formed, and as an electrode corresponding to the third deflecting electrode 6, a deflecting electrode 7 was formed. Further, except that the thickness of the cathode electrode 2 was taken as 55 nm and the thickness of the deflecting electrode 7 was taken as 20 nm, the size of the electron emitting device was made the same as the example 1.

Subsequently, the anode electrode 9 was disposed so as to be opposed to the electron emitting device prepared by the comparison example 1, and in the vacuum envelope, the voltage was applied to the cathode electrode 2, the extraction electrode 3, and the deflecting electrode 7 as well as the anode electrode 9 of the electron emitting device, thereby estimating the region of the electrons reaching the anode electrode 9.

When an effective light emitting portion was measured by the same driving condition as the example 1, the length of the effective light emitting portion in the X direction was 170 μm, and the length of the effective light emitting portion in the Y direction was 120 μm.

Since the constitution of the example 1 was made the same thickness as the cathode electrode 2 and the third deflecting electrode 6, compared with the case of the comparison example 1 where the thickness of the deflecting electrode 7 was made thinner than the thickness of the cathode electrode 2, the electrons emitted from the electron emitting portion of the cathode electrode 2 were effectively slowed down and stopped. As a result, it was possible to control the length in the Y direction of the region of the electrons irradiated at the anode electrode 9. Further, in the example 1, since the first deflecting electrode 4 and the second deflecting electrode 5 were provided in such a manner as to allow the electrons emitted from the electron emitting portion of the cathode electrode 2 to be focused in the X direction, compared with the comparison example 1, it was possible also to control the length in the X direction of the region of the electrons irradiated at the anode electrode 9.

Further, as a comparison example 2, an example is shown where the electron emitting device shown in FIGS. 2A to 2D are prepared.

The electron emitting device was prepared by the same method as the processes 1 to 3 of the example 1. Further, except that the shortest distance b between the first deflecting electrode 4 and the second deflecting electrode 5, which nip the electrons emitted from the electron emitting portion of the cathode electrode 2, is taken as 100 μm the size of the electron emitting device was taken as the same as, the example 1. The electron emitting device of the comparison example 2 is constituted where the relational formula 1 shown in the example 1 is not satisfied.

Subsequently, the anode electrode 9 was disposed so as to be opposed to the electron emitting device prepared by the comparison example 2, and in the vacuum envelope, the voltage from the voltage supply means 13 was applied to the anode electrode 9 and each of the electrodes 2 to 6 of the electron emitting device, thereby estimating the region of the electrons reaching the anode electrodes 9.

When an effective light emitting portion was measure by the same driving condition as the example 1, the length of the effective light emitting portion in the X direction was 160 μm, and the length of the effective light emitting portion in the Y direction was 100 μm.

In the comparison example 2, since the thickness of the cathode electrode 2 was made the same as the third deflecting electrode 6, it was possible to make the length in the Y direction of the region of the electrons reaching the anode electrode 9 shorter compared to the comparison example 1 where the deflecting electrode 7 was made thinner than the cathode electrode 2. Further, in the comparison example 2, since the first deflection electrode 3 and the second deflecting electrode 4 were disposed, compared to the comparison example 1, it was possible to make the length in the X direction of the region of the electrons reaching the anode electrodes 9 shorter. However, in the comparison example 2, since the condition of b≦4a of the relational formula 1 is not satisfied, compared with the example 1 where the relational formula 1 is satisfied, it was not possible to control the broadening in the X direction of the region of the electrons reaching the anode electrode 9.

This application claims priority from Japanese Patent Application No. 2004-379953 filed on Dec. 28, 2004, which is hereby incorporated by reference herein.

What is claimed is:

1. An image display apparatus, comprising: an electron emitting device disposed on a substrate, and an anode electrode disposed in opposition to the substrate, wherein the electron emitting device comprises, on a substrate, a cathode electrode comprising an electron emitting portion;

an extraction electrode extracting electrons from the electron emitting portion, said extraction electrode applied with a voltage higher than the voltage of said cathode electrode; and a deflecting electrode deflecting the electrons extracted from said electron emitting portion, said deflecting electrode applied with a voltage lower than the voltage of said extraction electrode, wherein said extraction electrode is disposed between said cathode electrode and said deflecting electrode, wherein said deflecting electrode comprises a first portion opposed to said electron emitting portion, and second portions disposed to nip a region between said electron emitting portion and said first portion in a direction crossing the direction along which said first portion and said electron emitting portion are opposed, and wherein, assuming that the shortest distance between an intersection between a center line of an opening provided in said extraction electrode and a surface including an end portion, at the side of said deflection electrode, of said extraction electrode and an end portion, at the side of said electron emitting portion, of said first portion is taken as a, the shortest distance between said second portions is taken as b, the shortest distance between the end portion, at the side of said electron emitting portion, of said first portion and the surface including end portions, at the side of said extraction electrode, of said second portions is taken as c, a distance between said cathode electrode and said anode electrode is taken as h, a thickness of said extraction electrode is taken as p, a thickness of said deflecting electrode is taken as q, a voltage applied to said extraction electrode in relation to said cathode electrode is taken as Vg, a voltage applied to said deflecting electrode in relation to said cathode electrode is taken as Vf, and a voltage applied to said anode electrode in relation to said cathode electrode is taken as Va, in the case of 0≦Vf<Vg, when $$a \geqq \sqrt{\frac{hq}{Va}}\left(\sqrt{Vg}+\sqrt{Vf}\right) \text{ and } b \leqq 4a \text{ and } c \leqq 4b \qquad \text{(Formula 1)}$$

are satisfied, and at the same time, in the case of Vf<0, $$a \geqq \sqrt{\frac{hp}{Va}}\,\frac{(Vg-Vf)}{2\sqrt{Vg}} \text{ and } b \leqq 4a \text{ and } C \leqq 4b \qquad \text{(Formula 2)}$$

and b≦4a and C≦4b (Formula 2)

are satisfied.

2. The image display apparatus according to claim 1, wherein the deflecting electrode is formed from a single member.

3. The image display apparatus according to claim 1, wherein a member including the first portion and a member including the second portions of the deflecting electrode are separated.

4. An image display apparatus, comprising: an electron emitting device disposed on a substrate, an anode electrode disposed in opposition to the substrate, wherein the electron emitting device comprises, on a substrate, a cathode electrode connected to an electron emitting portion;

an extraction electrode extracting electrons from the electron emitting portion, said extraction electrode applied with a voltage higher than the voltage of said cathode electrode; and a deflecting electrode deflecting the electrons extracted from said electron emitting portion, said deflecting electrode applied with a voltage lower than the voltage of said extraction electrode, wherein said extraction electrode is disposed between said cathode electrode and said deflecting electrode, wherein said deflecting electrode comprises a first portion opposed to said electron emitting portion, and second portions disposed to nip a region between said electron emitting portion and said first portion in a direction crossing the direction along which said first portion and said electron emitting portion are opposed, wherein a part of an end portion, at a side of the extraction electrode, of the cathode electrode is spaced from the cathode electrode extraction electrode rather than the other part of the end portion, and is electrically connected to the electron emitting portion, and wherein, assuming that the shortest distance between an intersection between a center line of an opening provided in said extraction electrode and a surface including an end portion, at the side of said deflection electrode, of said extraction electrode and an end portion, at the side of said electron emitting portion, of said first portion is taken as a, the shortest distance between said second portions is taken as b, the shortest distance between the end portion, at the side of said electron emitting portion, of said first portion and the surface including end portions, at the side of said extraction electrode, of said second portions is taken as c, a distance between said cathode electrode and said anode electrode is taken as h, a thickness of said extraction electrode is taken as p, a thickness of said deflecting electrode is taken as q, a voltage applied to said extraction electrode in relation to said cathode electrode is taken as Vg, a voltage applied to said deflecting electrode in relation to said cathode electrode is taken as Vf, and a voltage applied to said anode electrode in relation to said cathode electrode is taken as Va, in the case of $0 \leqq Vf < Vg$, when $$a \geqq \sqrt{\frac{hq}{Va}}\left(\sqrt{Vg} + \sqrt{Vf}\right)$$

and $b \leqq 4a$ and $c \leqq 4b$ (Formula 3)

are satisfied, and at the same time, in the case of $Vf < 0$, $$a \geqq \sqrt{\frac{hp}{Va}}\,\frac{(Vg - Vf)}{2\sqrt{Vg}}$$

and $b \leqq 4a$ and $c \leqq 4b$ (Formula 4)

are satisfied.

5. The image display apparatus according to claim 4, wherein the deflecting electrode is formed from a single member.

6. The image display apparatus according to claim 4, wherein a member including the first portion and a member including the second portions of the deflecting electrode are separated.

* * * * *